US006719648B1

(12) United States Patent
Smith

(10) Patent No.: US 6,719,648 B1
(45) Date of Patent: Apr. 13, 2004

(54) PRECISE FIT GOLF CLUB FITTING SYSTEM AND GOLF SHAFT SELECTION METHODS AND APPARATUS

(76) Inventor: Earl F. Smith, 401 Elizabeth Lake Dr., Hampton, VA (US) 23669

( * ) Notice: Subject to any disclaimer, the term of this patent is extended or adjusted under 35 U.S.C. 154(b) by 0 days.

(21) Appl. No.: 08/863,893

(22) Filed: May 28, 1997

Related U.S. Application Data

(60) Provisional application No. 60/018,574, filed on May 29, 1996.

(51) Int. Cl.[7] ..... A63B 53/00
(52) U.S. Cl. ..... 473/409
(58) Field of Search ..... 473/409, 289, 473/223; 74/491

(56) References Cited

U.S. PATENT DOCUMENTS 5,163,681 A * 11/1992 Hodgetts ..... 473/289
5,821,417 A * 10/1998 Naruo ..... 73/491

FOREIGN PATENT DOCUMENTS

WO WO 96/11726 * 4/1996

* cited by examiner

*Primary Examiner*—Stephen Blau
(74) *Attorney, Agent, or Firm*—Paul V. Del Giudice

(57) ABSTRACT

The invention related to methods and a system fro precisely fitting a golfer to a selected stiffness of golf shaft and to a selected flex choice of golf shaft. Heretofore and presently, a long felt need exists for methods and means to precisely fitting a golfer to a particular golf shaft whose values of stiffness and flex choice are applicable to a player of a specific skill level in the game of golf. Present day club fitting systems and methods are very expensive, complex and do not provide methods and means for precisely fitting a golfer to the most important part of a golf club, the golf shaft and its stiffness and flex point or kick point values, to allow a player to possess accuracy and consistency in his or her golf swing/shot performance. The present inventive methods and the system invention disclosed herein satisfy this long felt need and provide accurate selection of a golf shaft for a player by providing the particular methods and analysis set forth hereinafter.

12 Claims, 9 Drawing Sheets

PRECISE FIT GOLF CLUB FITTING SYSTEM AND GOLF SHAFT SELECTION METHODS AND APPARATUS

This application claims the benefit of U.S. Provisional Application No. 60/018,574, filed May 29, 1996.

BACKGROUND OF THE INVENTION

The invention relates to methods and a system for precisely fitting a golfer to a selected stiffness of a golf shaft and to a selected flex choice of a golf shaft. Heretofore and presently, a long felt need exists for methods and means for precisely fitting a golfer to a particular golf shaft whose values of stiffness and flex choice are applicable to a player of a specific skill level in the game of golf. Present day clubfitting systems and methods are vary expensive, complex and do not provide methods and means for precisely fitting a golfer to the most important part of a golf club, the golf shaft and its stiffness and flex point or kick point values, to allow a player to possess accuracy and consistency in his or her golf swing/shot performance.

The present inventive methods and the system invention disclosed herein satisfy this long felt need and provide accurate selection of a golf shaft for a player by providing the particular methods and analysis set forth hereinafter.

OBJECTS OF THE INVENTION

The objects, features and advantages of the inventive methods and system of the present invention will be apparent from the following more detailed description of the methods of the invention and a system embodiment, as illustrated in the accompanying drawings.

DETAILED DESCRIPTION OF THE INVENTION

Figure 1:
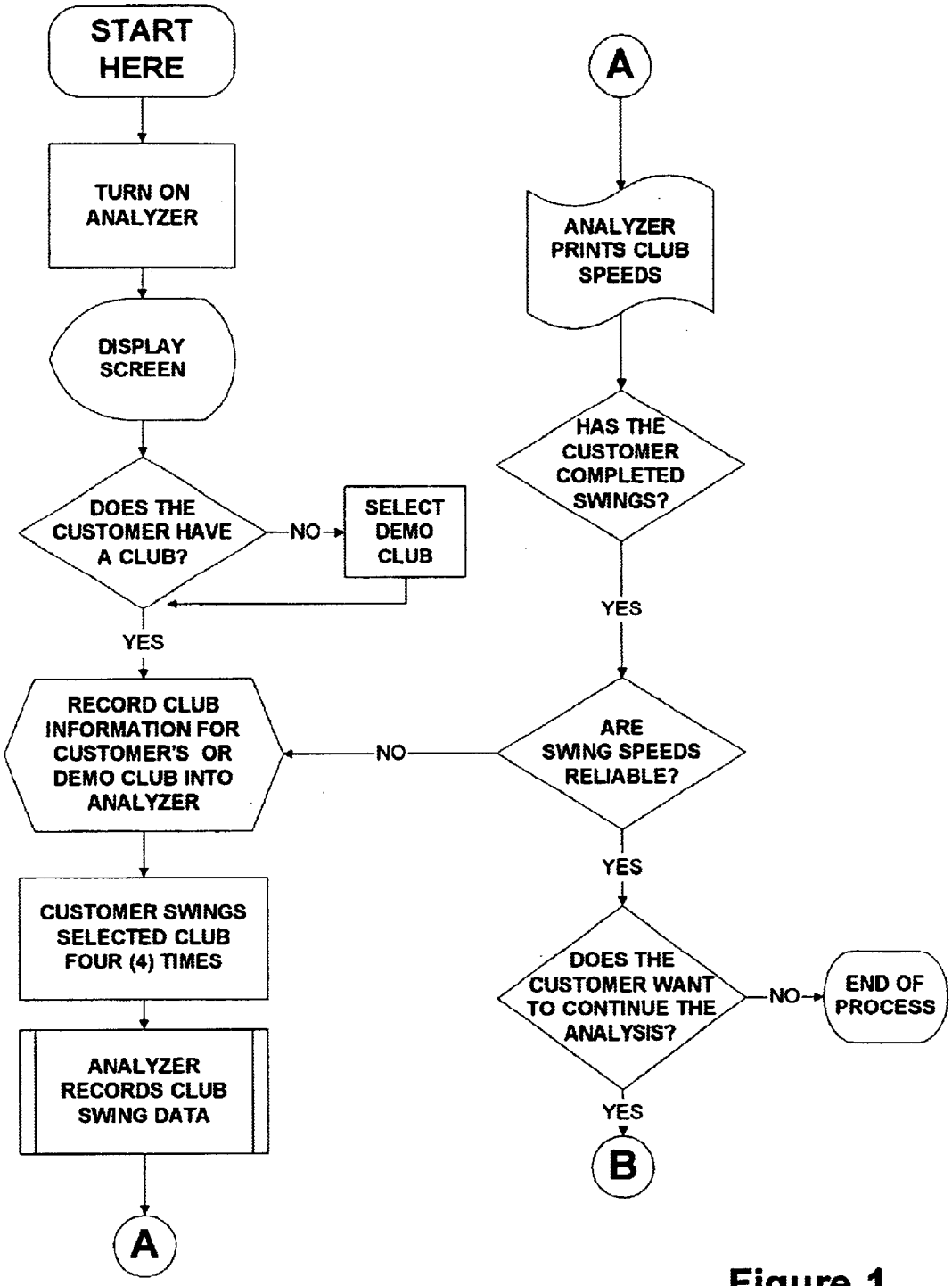
FIGS. 1–6 contain the flow charts for the methods of operation of the present invention, which are shown in detail and which are referenced in the disclosure.

In order to determine if the golfer has the correct golf shaft for his or her golf swing it is necessary to first test the golf equipment they are currently playing. The shot/swing analyzer currently used is the Miya Computer shot Analyzer, Model number SM 306-1 and 306-2 manufactured by Miyamae Ltd. of Japan. This Miya Computer Shot Analyzer 10 records speed, angle, distance, deflection and path in multiple display functions. A comparable unit (current or future) could be used for the testing.

Initially, my swing shaft/selection analyzer will record the speed of the swing at impact using the golf club or clubs a player is currently playing. If the golfer's equipment is not present, demos are made available. The shafts needed and used for testing will be recorded individually. Set the shot analyzer for the individual club you wish to test via switch 11 and the choice can be either woods or irons. For my purposes I have selected the customers' five (5) iron for the initial test. The customer will swing the club, on the swing analyzer a plurality of times; i.e., four (4) times; to establish the initial swing speeds. Each individual reliable swing speed and swing will be recorded separately to afford comparison thereof to other recorded swing speeds and the test parameters of the shaft selection process. If the golfer's current equipment is not available, the demo club in steel in the R stiffness, as established by prior art, will be selected to begin the testing. The process/method may proceed with the R stiffness in any flex choice for the initial test.

As stated above, my swing shaft/selection analyzer may include a club selection switch 11 for any irons or woods for which speeds wish to be tested. The Miya Shot Analyzer recording device I am currently using includes these options, which can include a full range of wood, iron and putter choices, as established by prior art. It is also possible to use various types of golf balls for the testing process. While it is desirable to test with golf balls, practice golf balls are also acceptable. With the use of practice balls or even golf balls, this allows the person doing the testing to offer this shaft fitting service in a confined area if an outdoor facility is not available. Either way is acceptable.

EXAMPLE: The customer wants to buy a full set, or an individual club which can be either woods or irons and expects to know his potential speed with a given product to give him or her confidence. The following minimal choices should be available: One wood or driver, 3 wood, 5 wood. Woods are now available up to and including a number 15 wood. These options should be available in case of need. In Irons: 3 iron, 4 iron 5 iron, 6 iron, 7 iron, 8 iron, 9 iron, Pitching Wedge and Putter. 1 iron, 2 iron and a full range of wedges are available on the market. Other options of irons should be available for testing if desired. This is another function of the machine 10 that does not include my invention analysis method.

The customer will swing the club, a plurality of times, i.e., four (4) times, and the analyzer 10 will record the club head speed of each individual swing. If the path of the swing does not pass through the sensors at the right or acceptable/reliable angles, the swing must be repeated. In order to proceed with the testing one needs reliable swing speeds to continue testing to arrive at the proper selection of stiffness and flex choice.

UNRELIABLE SWING SPEEDS EXAMPLE: If speeds of 110, 50, 50 and 110 mph would be generated and recorded, the descending angle of the club is too steep. This is evident by the large fluctuation of these various recorded speeds. The 110 mph or the 50 mph speeds recorded collectively are thus unreliable and should not be used for the analysis/test in this instance. Another example would be recorded speeds of 60, 90, 90, and 60 mph. In this case, you have to retest, the club head path as it crosses the sensors 13A and 13B is again too steep. In order to continue testing, reliable recorded speeds should not vary from each other more than 10 to 15 mph at a maximum to insure acceptable parameters for selection of the correct shaft by my inventive process/method.

RELIABLE SWING SPEEDS EXAMPLE: Reliable or acceptable swing speeds are defined as speeds recorded a plurality of, i.e., four (4) times that do not exceed/vary from one another more than 15 mph in order to provide and insure correct shaft selection. Acceptable test speeds could be 77, 92, 84, 90 mph. Other examples are 86, 89, 81, 88 mph; 79, 76, 74, 78 mph; or 88, 89, 86, 90 mph. These are only examples, and numerous other examples could be provided. Any complete series of reliable swing test speeds: i.e. four (4) times, that register less than or equal to 85 mph; or, any complete series of reliable swing speeds, i.e. four (4) times, that register more than 86 mph in the testing will verify the selection process of the proper stiffness of the correct shaft selected for further testing. This insures accurate selection of the shaft process as the analysis continues. This unique or novel discovery I have made from conducting tests with available shafts provided by the manufacturers, as established by prior art, can effect the afore-mentioned 85 mph parameter I have discovered. If shafts provided by the manufacturers in the future vary from these prior art shafts, then most probably this 85 mph parameter criteria may change to plus or minus 85 mph. This change will be discoverable by conducting tests with the shafts to be provided in the future by the manufacturers. This also applies to the speed ranges shown in FIG. 3, for the L, A, R, S, X etc. shaft stiffness identifications/ranges.

As set forth above, if the customer does not have his or her own equipment, select the demo 5 iron for the initial test in R stiffness. The recorded speeds generated by this demo shaft will be recorded. The examples of reliable and unreliable speeds shown above will apply. The speeds recorded will allow selection of the stiffness of shafts to continue the testing as determined by the flow chart shown in the drawing figures, i.e. FIG. 3.

The shaft swing/selection analyzer 10 will record the speeds of the swing of each club chosen for testing and display it on the monitor in order to determine what will be the next sequence that takes place, and the reliable speeds are recorded.

As shown in FIG. 1, a question is asked of the customer from a display screen 18, "Has customer completed swings, YES or NO?". If the answer is yes, then the customer is asked if he or she wants to continue the analysis, YES or NO? The process will end if the answer is, NO. The software may be customized for additional information. However, it does not change my inventive process/methods.

Figure 2:
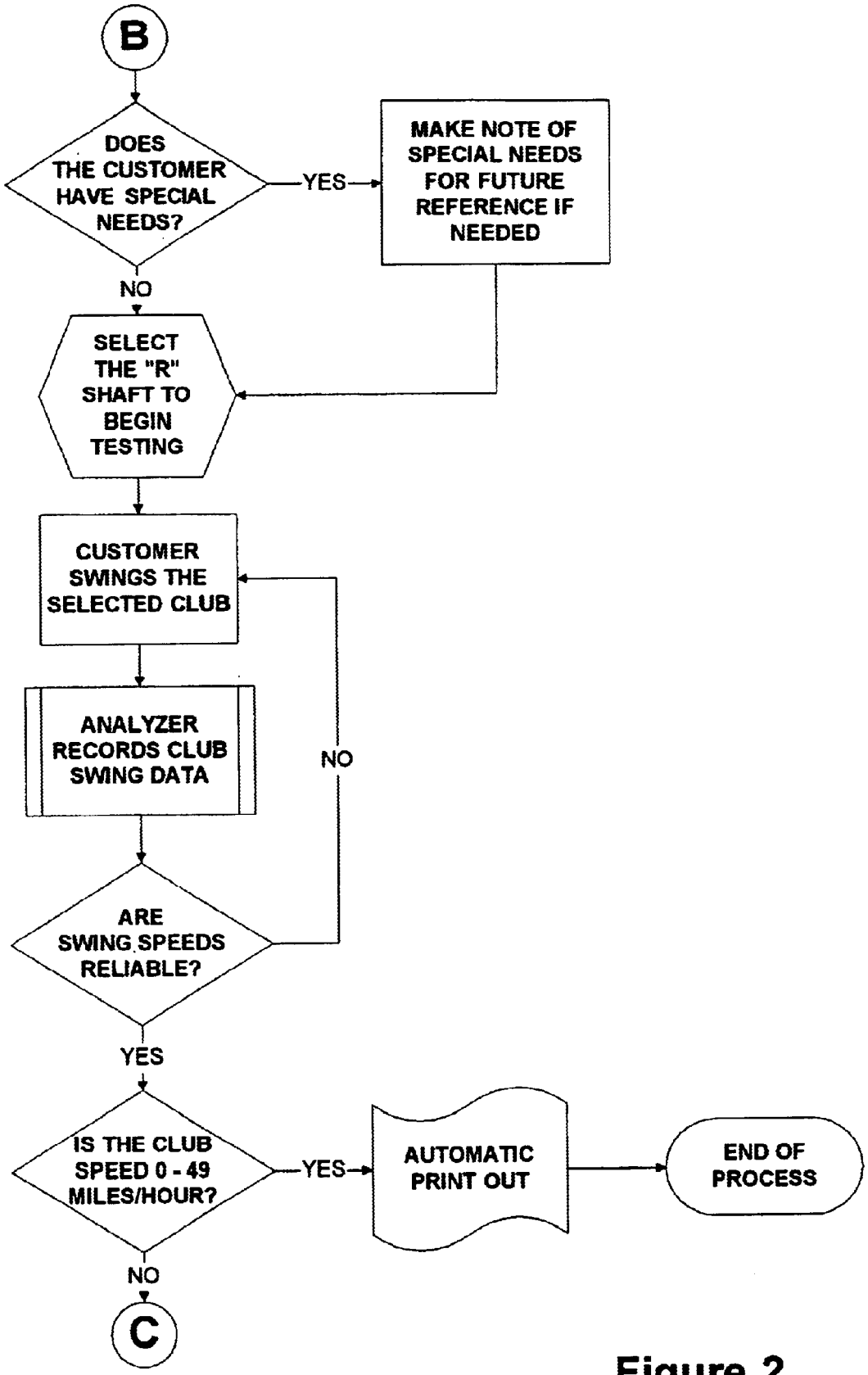

If the answer is YES, then the customer will continue the testing. If the customer has a physical limitation or has special needs, the invention system and methods insure the final product will take into consideration any special needs, which is shown in FIG. 2, an information sheet entitled, "Customer's Special Needs," will enable the operator to incorporate the information into the finished documentation and enable the operator an the one being tested to participate. It does not change any part of the process and the testing continues. The software may be customized for additional information, however, it does not change my inventive process/methods.

As presented, for test purposes I have chosen the customer's 5 iron because it is in the middle of the spectrum of the set of irons. By using the 5 iron, I have found that it may not be necessary to test the other irons in the set to record individual reliable speeds or to complete the process of selecting the correct shaft for a customer. However, another mid-iron could be used for selection of the correct shaft by my inventive process/methods. For best results, it appears that the 5 iron should be the club of choice. The club head weights and the finished lengths of the shafts and grips, after assembly, are comparative to the 5 iron as established by prior art at this time.

Figure 3:
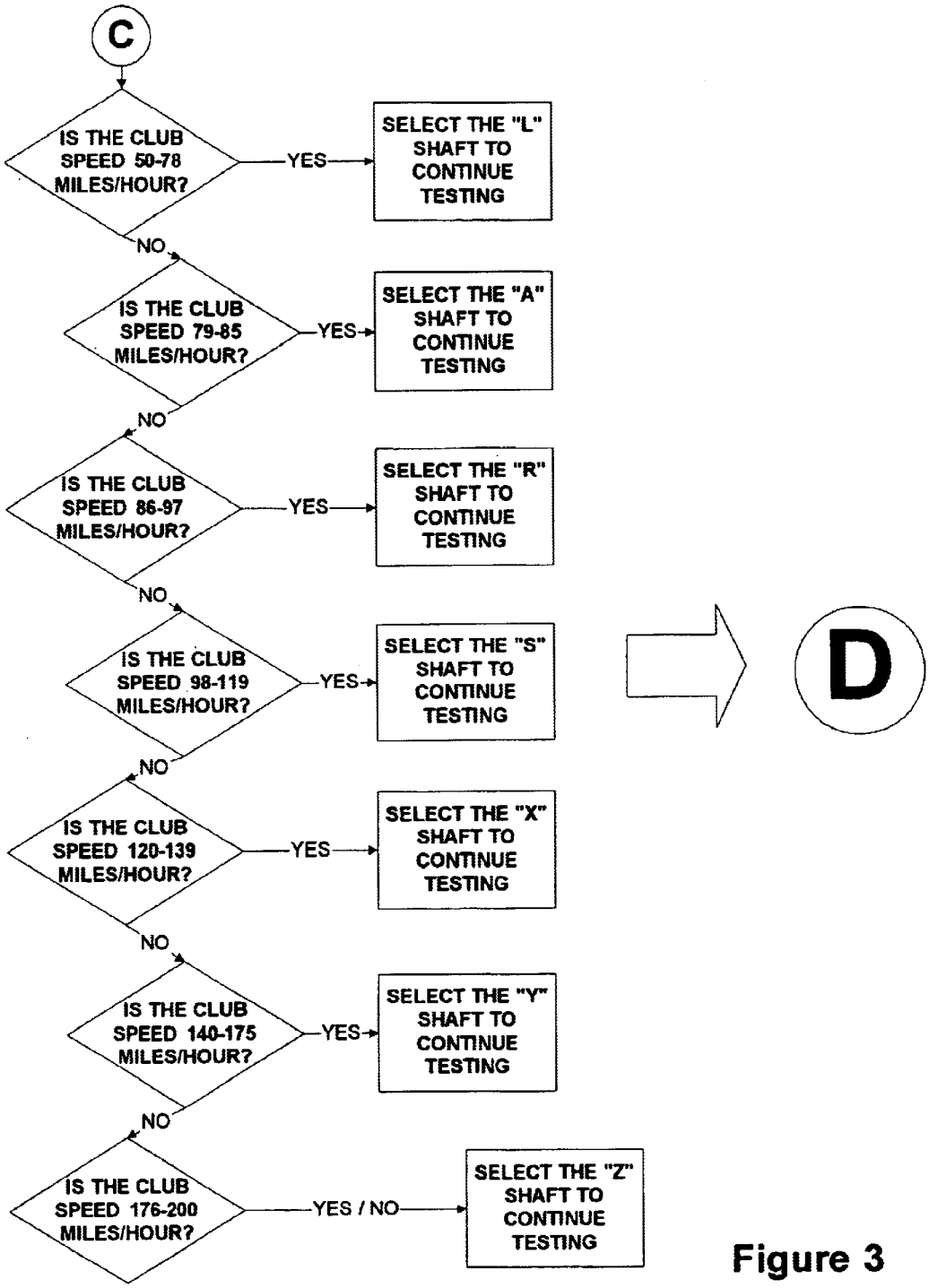
Figure 4:
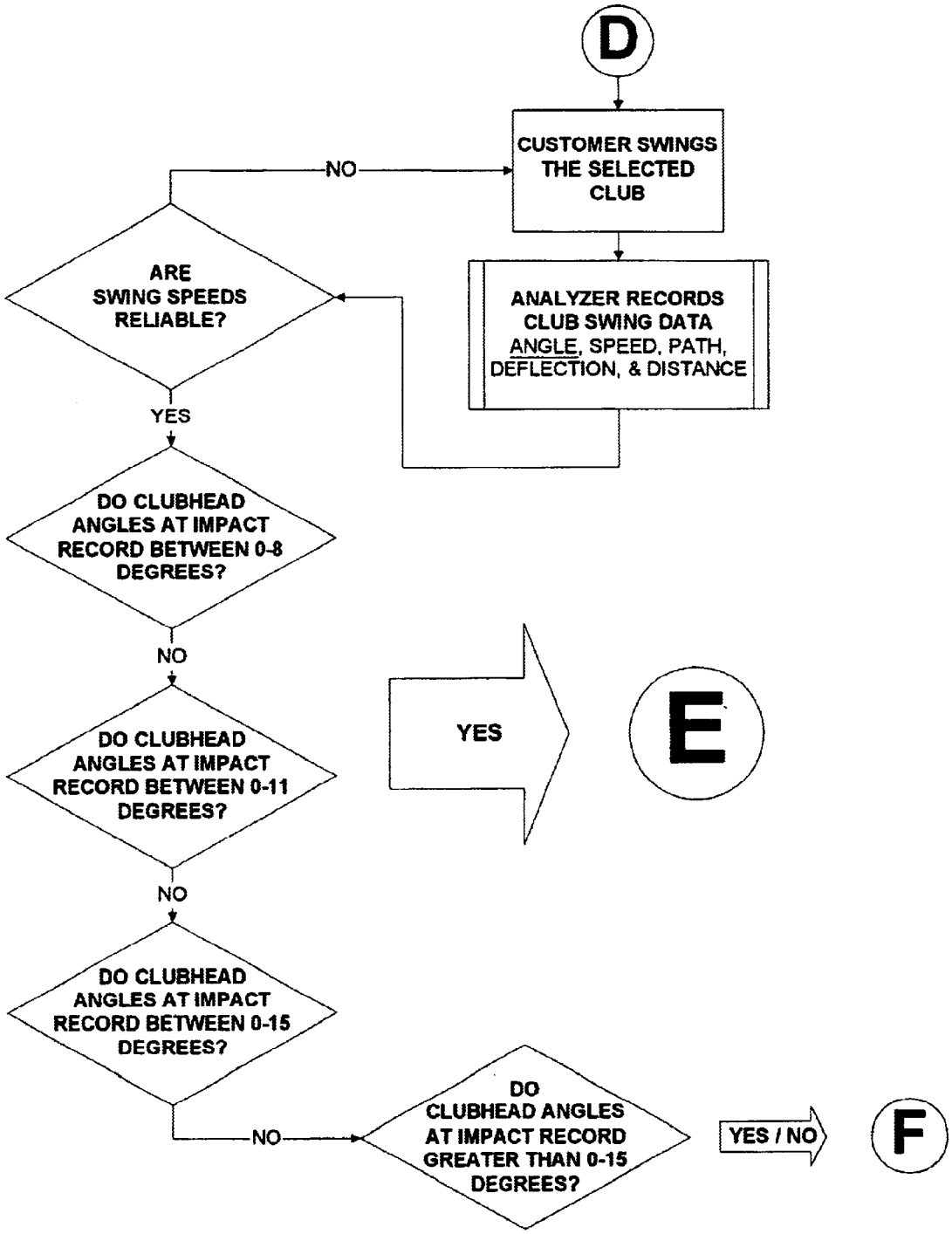

NOTE: With any club the shaft swing/selection analyzer will record the club head speed of each swing. The instructor supervising the tests may choose to have the golfer provide another set of reliable speeds for testing in another stiffness. The comparison between stiffnesses should be made with the same clubs (example: 5 irons) for best results. The club head speeds are recorded, i.e. four (4) times, and the same procedure used with the golfers own equipment is followed. The reliable speeds recorded, will provide the necessary information to select the proper shaft stiffness to continue the testing. The customer then swings the club with the shaft selected for testing according to the average miles per hour or decision box it falls within, which is shown in FIGS. 3 and 4. This also helps establish the parameters to continue the testing if any confusion exists.

As further shown in FIG. 3, the shaft selected for the tested and recorded reliable swing speeds are:

50–78 mph—The "L" shaft is selected.

79–85 mph—The "A" shaft is selected.

86–97 mph—The "R" shaft is selected.

98–119 mph—The "S" shaft is selected.

120–139 mph—The "X" shaft is selected.

140–175 mph—The "Y" shaft is selected.

176–200 mph—The "Z" shaft is selected.

Shafts with different flex points, or kick points, or flex choices, can vary according to prior art as provided by different manufacturers, but the stiffness parameters must be adhered to in this portion of the testing based on the reliable speeds recorded. Once the stiffness parameters have been established, it is advisable to have a minimum of four (4) different flex choices or kick points in a specific stiffness selected for testing. It has been my experience that two (2) shafts are not enough and as many as 100 shafts, as advocated by some, are too many. The basic shafts within a specific stiffness with different flex or kick points should include: low, mid, mid-high and high, as established by the prior art. There are other combinations or variations as established by prior art, and in the future there will be other combinations. It has been my experience that this latitude will give the instructor/clubfitter or operator the greatest scope of choice for the individual golfers with the wide range of swings associated with golf as established by prior art, current or future.

Further, with respect to FIG. 3, shafts in order of stiffness as established by prior art are and include: L, A, R, S, X, alone or in combinations, as established by proprietary rights of the different manufacturers. Examples of combination shafts as established by prior art are and include: A/L, R/S. Individual shafts include FM Precision 7.5 FM, 8.0 FM and 8.5 FM. Other combinations and/or individual stiffness are available on the market today, as established by prior art.

For background information, while taper tip shafts were the choice of manufacturers for golf equipment in the past there are still a few companies that utilize them in the manufacturing of golf equipment.

Depending on the individual golf club manufacturer, three (3) to eight (8) individual golf shafts were carried in stock to build a set of clubs in a specific stiffness. Individual shaft choices such as L, A, R and S could be carried in stock as separate shafts in a specific stiffness. The shape of the shaft at the tip tapered to a predetermined diameter. For example at the top of the hosel where the shaft is inserted the diameter would be 0.370 when seated in the club head, and at the bottom of the hosel where the shaft is inserted (bottom or seated) the diameter would be for example 0.355 thus creating the taper effect. This changed slightly from manufacturer to manufacturer. All of that changed with the advent of the "combination shaft". The most popular shafts in use today are available in A/L or R/S combinations of stiffness. It is a parallel tip shaft, not a taper tip shaft. The shape was uniform from the first step in most instances continuing to the tip bottom. The advantage to this was you no longer had to carry so many shafts. The golf head at the hosel now could be drilled in a parallel bore. This was more economical for the manufacturer and sales company. Two shafts took the place of a usual number of approximately twelve (12) to thirty-two (32) shafts depending on the individual manufacturer. This cut down on cost and inventory and made it more economical and manageable for the manufacturer. The combination shafts, however, created a loss of approximately ten (10) yards in distance per individual club. In years past, a set of irons might consist of a 2, 3, 4, 5, 6, 7, 8, 9 iron with taper tip shafts. The loft of each iron would vary three (3) to four (4) degrees depending on the individual specifications of each manufacturer. In order to compensate for this loss of approximately ten (10) yards, the lofts were changed by the manufacturers to accommodate the new combination shafts. Current iron sets customarily consist of 3 thru Pitching Wedge. Thus a 9 iron with 48 degrees became 42 or 44 degrees. A pitching wedge that was 50 or 52 degrees now became 46 or 48 degrees. Was this an improvement in distance or equipment? No, this made the manufacturing more economical and efficient. Shafts are still available in taper tip in individual stiffness. Combination taper tip shafts in irons may exist, as established by prior art, but not to my discovery to date. Moreover, these "combination shafts" make proper shaft selection, or "clubfitting", difficult, if not impossible.

My shaft swing/selection analyzer method inventions will record and properly test and/or select any shaft made now by prior, current or future art.

Based on a plurality of the highest reliable club head speeds for the range or ranges of the parameters shown, the shaft or shafts in that stiffness that have been selected are now ready for testing. Each individual shaft that has been selected has a different FLEX POINT, KICK POINT OR FLEX CHOICE as they are sometimes referred to, as established by prior art.

EXAMPLE: With reference to FIG. 4, if the stiffness R has been selected, a minimum of four (4) different shafts in that stiffness with different FLEX POINTS, KICK POINTS OR FLEX CHOICES are used for the testing. While it is possible to make a selection with fewer shafts, it is advisable to test a full range of flex choices in shafts to arrive at the best choice for that individual. By testing the shafts in the stiffness selected with different flex points it is possible to deduce which shaft in that stiffness will create the desired results to make a correct selection possible; or in other words, it is possible to determine which shaft selected meets the selection criteria of my invention methods and analysis.

As shown in FIG. 2, if the reliable club head swings register between 0 to 49 miles per hour, a set of instructions will appear on the screen and the shaft that has been chosen will be printed out and that will be the end of the process. The operator will fill in the needed information that will be required to complete the set, (height, length, size of grip and choice), and this information is included in the final sheet and that is the end of the process. This is done because the swing speeds are too slow or low to cause or promote the shaft to bend when striking the ball. Normally, an "L" is selected/chosen. This is based on shafts available in L, A, R, S, X or combination shafts, or any shafts that existed prior, current or developed in the future. If the swing speeds recorded are higher than 0 to 49 MPH, then the process continues, as shown in FIG. 3.

Figure 5:
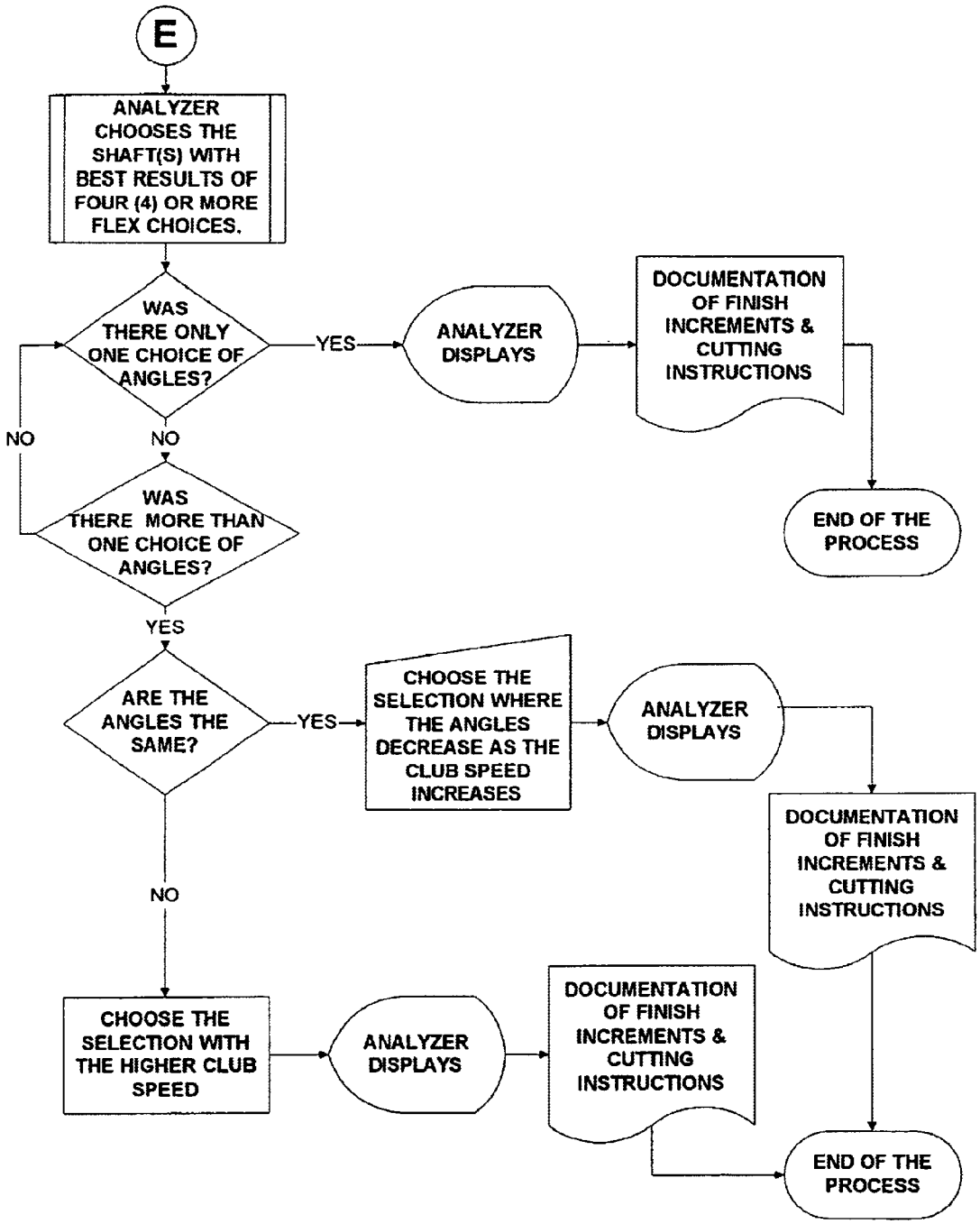
Figure 6:
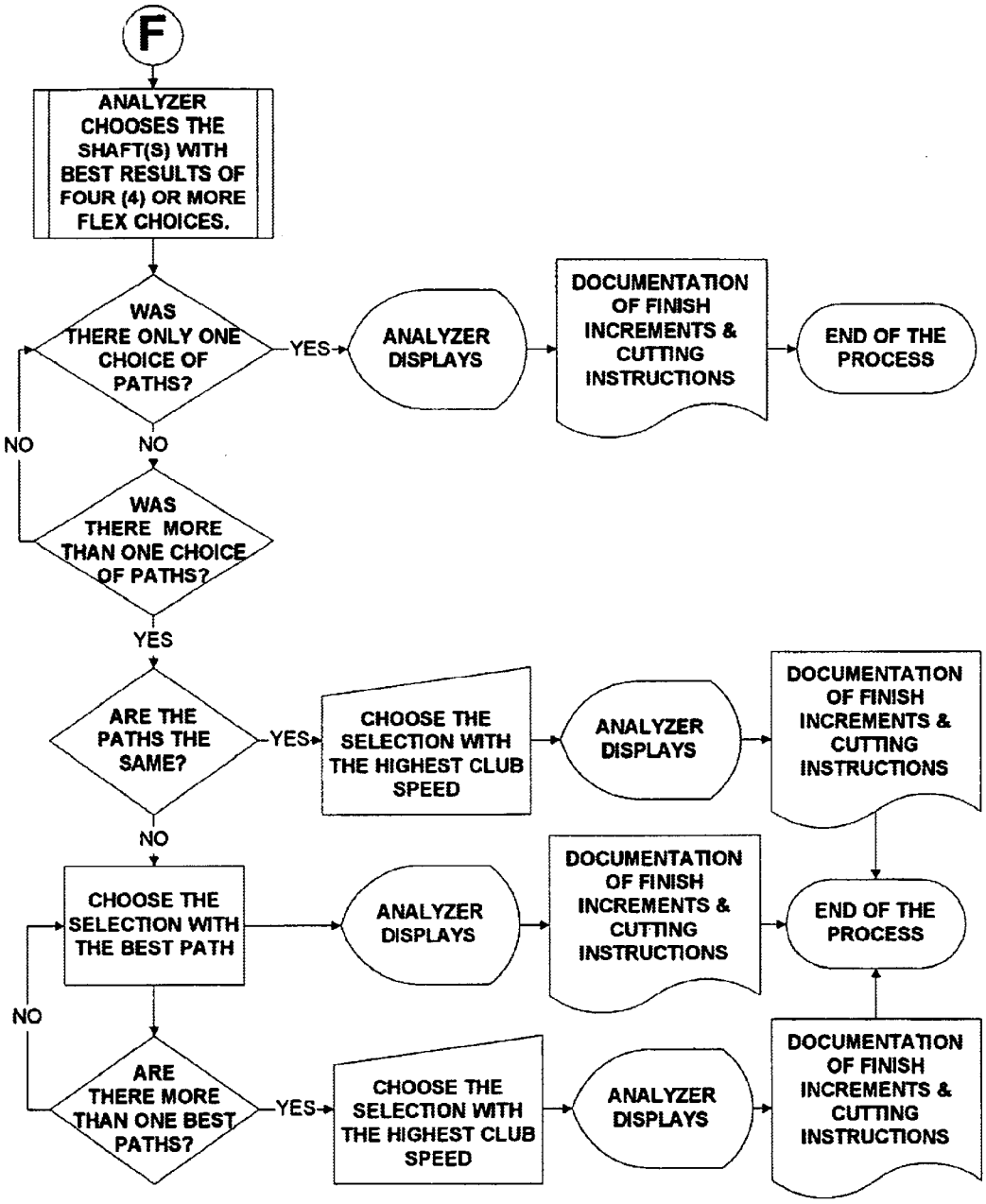
Figure 7:
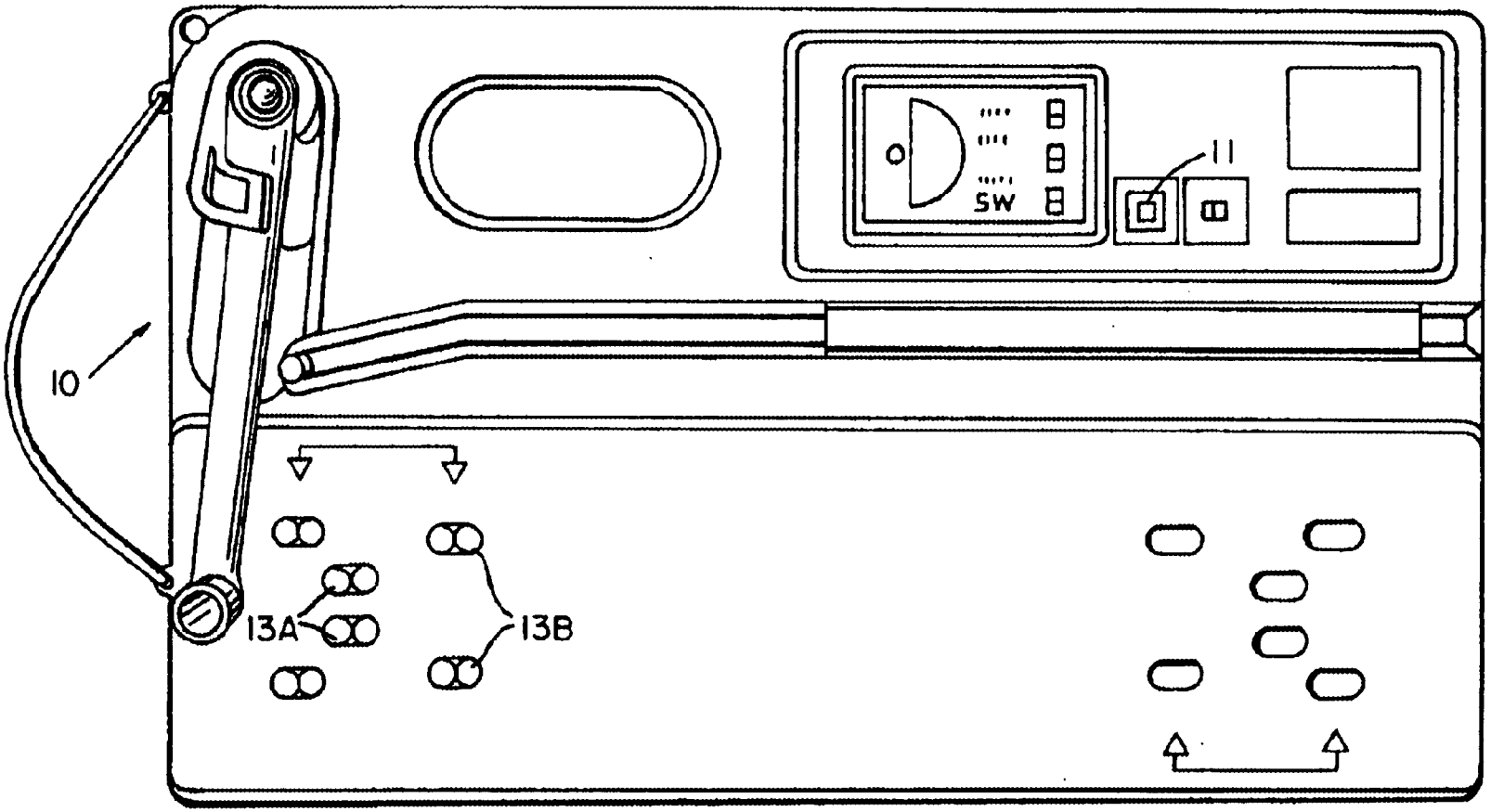
FIG. 7 shows an exemplary swing/shot analyzer device 10 which is utilized to test speed, angle, distance, deflection and path in multiple display functions.
Figure 8:
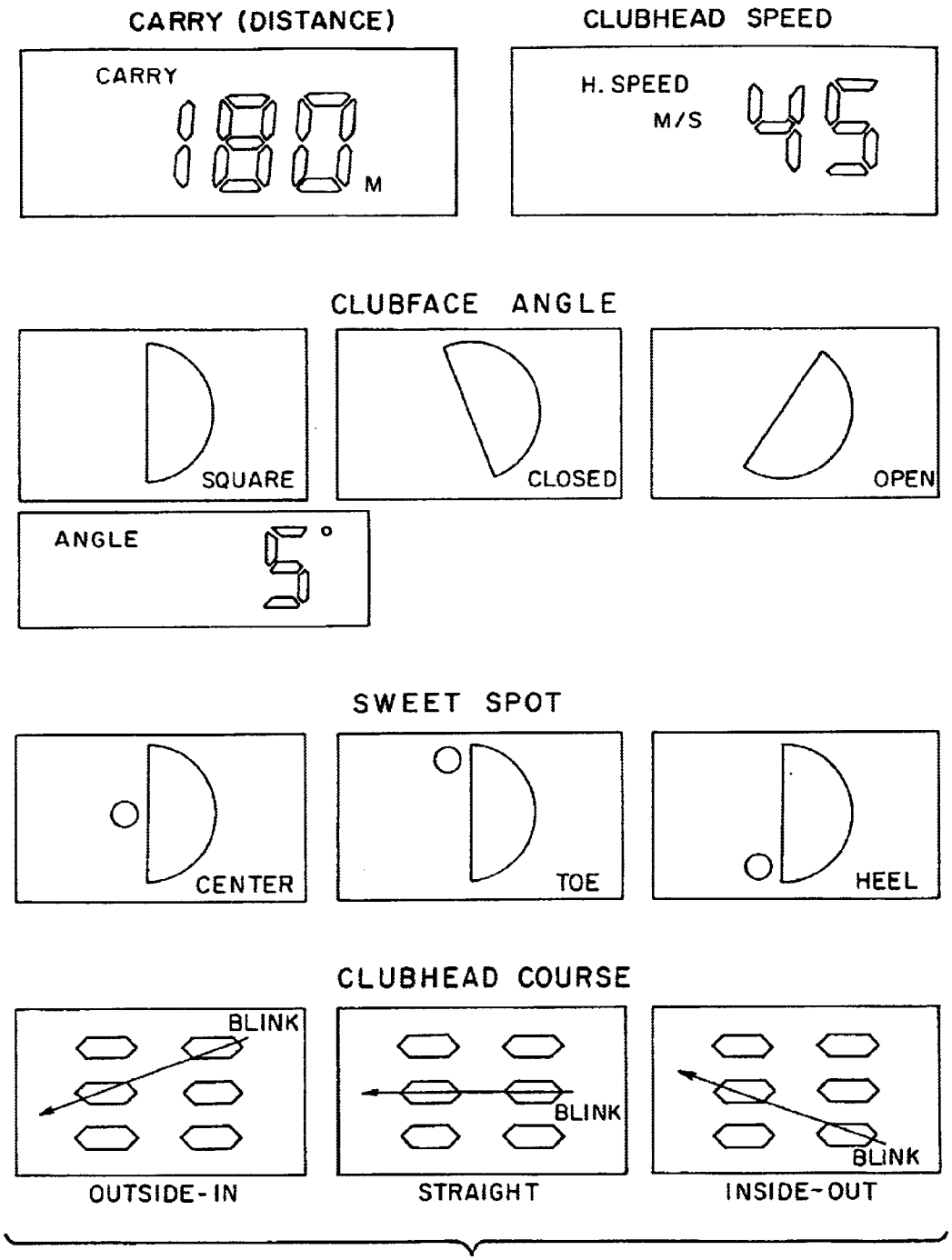
FIG. 8 depicts certain displays of the swing/shot analyzer device 10.

With reference to FIG. 4, the testing will now continue with the following input. The reliable speeds which was the primary consideration to arrive at this phase of the testing to select shaft stiffness, I have found become secondary to the ANGLES/DEGREES (deflection), of the club head open or closed at impact. We will have now established the stiffness as set forth above, continue the tests and begin testing the different flex points in shafts after the stiffness has been selected in the order of primary importance: first-ANGLES/DEGREES, then Speed, then Swing Path Deflection, and lastly Distance, (with flex choices) in that specific order are now recorded. The selection for the shaft stiffness being tested based on the highest reliable speeds recorded would have been chosen. There should be a minimum of four (4) flex choices offered in each stiffness L, A, R, S, X, as established by prior art. The 7.5 FM(x), 8.0 FM(y), 8.5 FM(z) are available in a variation of the flexes as established by prior art. The customer now swings each shaft in the selected stiffness in different flex choices a minimum of, i.e. four (4) times. This equals to a minimum total of sixteen (16) swings or 4 times 4=16. Each individual swing will be recorded by the analyzer and stored. Information obtained from the analyzer and stored consists of angles/degrees, reliable speeds, path deflection and distance. After all the flex choices used for testing in that specific stiffness have been swung (for testing purposes; 4×4=16) on the analyzer and recorded individually or separately, a series of decisions will be made, as shown in FIGS. 4–6.

For test purposes I am using four (4) different flex choices in a specific stiffness that was selected and is being recorded. There are now four (4) flex choices that are possible in testing in each stiffness as determined by reliable club head speeds. Through an orderly process of elimination I will arrive at one choice as the best selection for the individual being tested. The order in which the first three choices will be made is based on the "ANGLE/DEGREES" the club head passed through the sensors at impact either open, closed or square. The "ANGLE/DEGREES," open or closed at impact, is now the first consideration in the first three choices offered. Zero degrees as recorded at impact with the i.e. four (4) swings, is the perfect angle of choice regardless of the reliable speeds recorded in a specific stiffness being tested in the four (4) flexes as illustrated in the following first three (3) examples. The fourth choice uses a different set of parameters to arrive at the desired conclusion or choice. You will note in the fourth choice the path of the club head at impact is the prime consideration, and the "ANGLE/DEGREES" is the second consideration.

As set forth above, after the reliable club head speeds in a specific stiffness have been established, one has four (4) test choices in each stiffness to choose from. The 1st choice is Zero to eight degrees, open or closed at impact; 2nd choice is Zero to 11 degrees, open or closed at impact; 3rd choice is Zero to 15 degrees, open or closed at impact; 4th choice, greater than 15 degrees, open or closed at impact. When a choice has been made in that specific order, the documentation contained within one test choice will identify the selection of the proper shaft stiffness and flex choice.

Cutting instructions for that specific choice are included in the final finished product and the process will end. Shaft cuts or tip cuts as established by prior, current or future art and recommended by the manufacturer may or may not be applicable in my inventive process.

Figure 9:
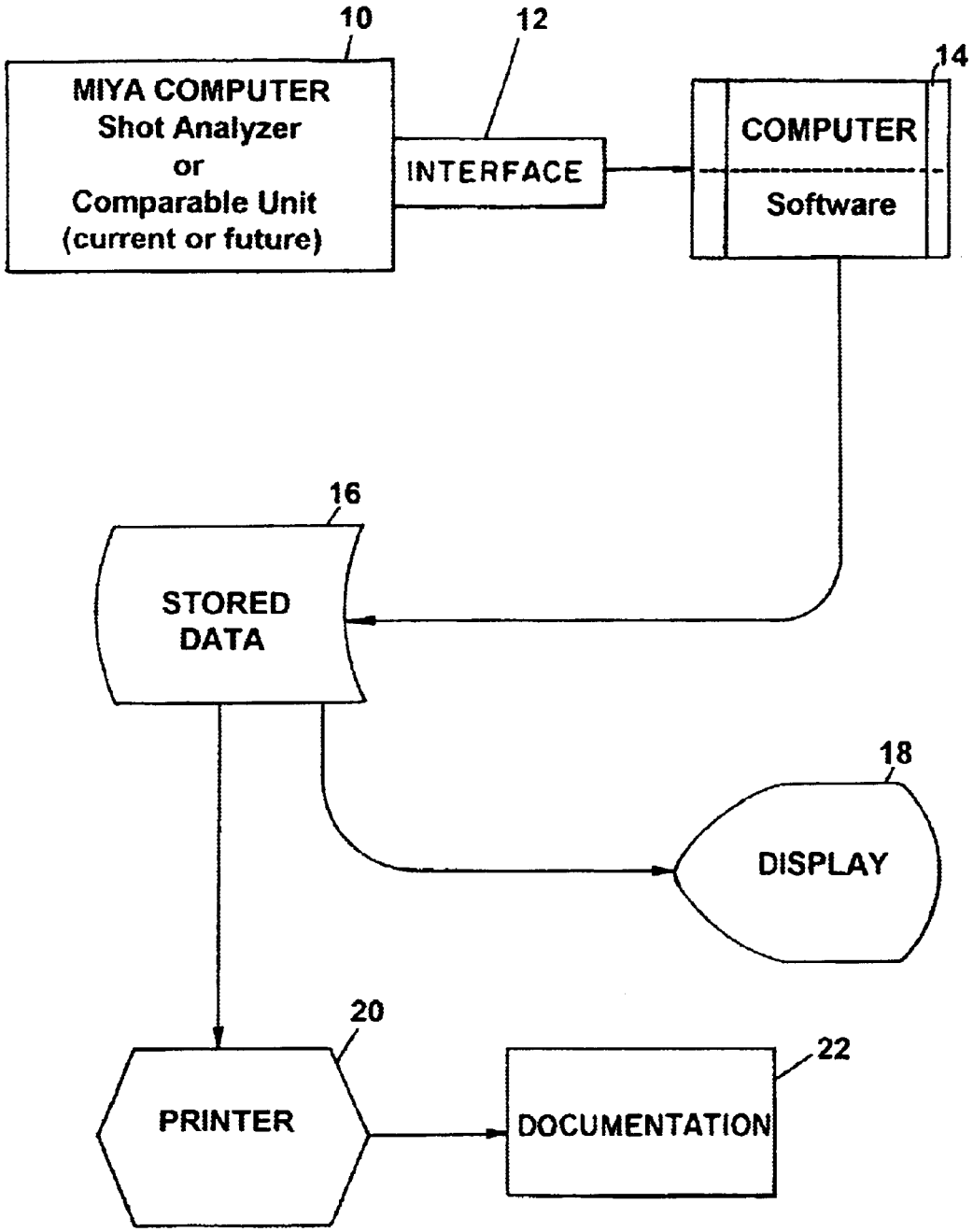
FIG. 9 shows a system embodiment of the present invention.

The inventive methods and system of my invention may be implemented into a fully automated software controlled system as shown in FIG. 9, and operator intervention may also be utilized. Furthermore, this is applicable to the determination of unreliable or reliable swing speeds. It should be within the skill of one ordinary skilled in the art to devise software for determining a reliable swing speed or an unreliable swing speed, by and within the invention teachings provided herein. My inventive methods and system may be provided in a fully automated system, or a semi-automated system which allows for operator intervention, in accordance with the present disclosure and the flow charts provided herein.

As follows, the four (4) Choices, in order of priority, are shown and the logical choices are outlined. A fifth example is enclosed to demonstrate the versatility of my invention in the event all of the ANGLES/DEGREES, open or closed at impact, should they occur in the tests for flex choice at the same time. In the examples below, any shaft stiffness selected by my invention methods/system can be substituted for the example given.

EXAMPLE-1st CHOICE 0 to 8 Degrees, Open of Closed at Impact

| ANGLES/DEGREES | SPEED | | ANGLES/DEGREES | SPEED | |
|---|---|---|---|---|---|
| LOW FLEX | 3 | 83 | HIGH FLEX | 8 | 85 |
| | 2 | 84 | | 12 | 85 |
| | 2 | 83 | | 6 | 83 |
| | 11 | 82 | | 6 | 84 |
| MID FLEX | 0 | 80 | MID/HIGH | 5 | 84 |
| | 0 | 78 | | 8 | 82 |
| | 0 | 79 | | 10 | 78 |
| | 0 | 80 | | 0 | 84 |

The four (4) shafts in a specific stiffness in different flex choices offered to determine the selection process of a specific flex in a specific stiffness, as shown in the example above, in order of the preferred choices, are as follows. The first or optimum choice as shown in the example is: MID FLEX. In all instances it is always desirable to have the ANGLE/DEGREES record ZERO for the plurality of swings, i.e. four (4).

Whenever the ANGLE/DEGREES record ZERO, i.e. four (4) times, and the reliable club head speeds recorded for the desired/selected stiffness are the fastest also, this will give you the optimum results for playability as it affords your swing. Zero degrees exemplifies "square at impact".

EXAMPLES: 1st Choice; In the above example the selection of flex choice is the MID FLEX in the A stiffness because the angles/degrees are "0" and the speeds are between 79–85 mph. Even though reliable speeds are higher in the other test examples of flexes (choices) as outlined in this example, the angles/degrees, open or closed at impact, are not within the limits or parameters as established for this first choice. The reliable club head speeds for this example conform to the question, "Is the club speed 79–85 MPH?". Unless the angles/degrees adhere to the choices in exacting order and the deductions are made in the correct order, the shaft that will work the best cannot be selected through an orderly process. This shaft can be selected in the proper flex choice, but not the proper stiffness, for best results.

If for example, the angles/degrees in the HIGH FLEX would read 0 degrees in the i.e. four (4) swings, then the choice would be the HIGH FLEX because the angles/degrees would equal to zero (0) and the reliable recorded speeds of the HIGH FLEX are greater than those recorded for mid-flex. In this instance the HIGH FLEX in the A shaft would be the shaft selection of choice. It is always better to choose the choice of flex as close to zero (0) as would be recorded. Also, it is permissible to record only three (3) swings in the testing process with reliable club head speeds and select the proper shaft. Also, it is important to note that the flex choice criteria may be based upon the one wherein the average of the angle/degrees, within the range of 0–8, is closest to zero degrees.

It is important to remember that in the above-referenced of: first three choices, 0–8 degrees, 0–11 degrees, 0–15 degrees, open or closed at impact; once the reliable speeds have been verified and assigned to their proper decision box to test within, it (reliable club head (swing) speeds) become (s) secondary to the angle/degrees, open or closed at impact, as close to zero degrees as is recorded. In the event two angle/degree readings are exact then the higher reliable speeds becomes the logical choice of the two based on a plurality of test swings. This event is not normal but could occur. It is not advisable to make a selection based on fewer than three (3) swings that are recorded. It is permissible to have as many reliable test speeds over the plural as desired but are not necessary, the choice falls within these parameters of 0 to 8 degree, open or closed at impact, the shaft is selected and then go to the print out sheet for final input and instructions.

EXAMPLE-2nd CHOICE 0 to 11 Degrees, Open or Closed at Impact

| ANGLES/DEGREES | SPEED | | ANGLES/DEGREES | SPEED | |
|---|---|---|---|---|---|
| LOW FLEX | 8 | 83 | HIGH FLEX | 8 | 85 |
| | 9 | 84 | | 10 | 85 |
| | 14 | 83 | | 12 | 83 |
| | 15 | 82 | | 11 | 84 |
| MID FLEX | 16 | 80 | MID/HIGH | 3 | 84 |
| | 17 | 78 | | 8 | 82 |
| | 15 | 79 | | 7 | 78 |
| | 14 | 80 | | 11 | 84 |

In the above example for the second choice, the MID/HIGH flex shaft in that particular stiffness of shaft selected for the test would be the proper selection because the angle/degrees are closest to zero. Let us assume in the example above that in the HIGH FLEX shaft of that particular stiffness selected for the test, 2nd choice the third ANGLE/DEGREE would be changed to read 11 degrees instead of 12 degrees. The selection would still be the MID/HIGH flex even though the ANGLE/DEGREES now fall into the second choice category of 0 to 11 degrees and the reliable speeds collectively are greater overall because the ANGLE/DEGREES of the four (4) speeds recorded in the MID/HIGH flex are still closer to 0 degrees, open or closed at impact. In the case of the second choice-ZERO to 11 degrees, open or closed at impact and the third choice-ZERO to 15 degrees, open or closed at impact, it is always desirable to come as close to ZERO degrees with the plurality of swings, i.e. four (4) times open or closed at impact. This will insure the most accuracy.

The selection in this $2^{nd}$ choice example is the MID HIGH for the first priority choice in this second example.

If the choice falls within these parameters 0 to 11 degrees, open or closed at impact, then go to the print out sheet for final instructions and finished input.

EXAMPLE-3rd CHOICE 0 to 15 Degrees, Open or Closed At Impact

| ANGLES/DEGREES | SPEED | | ANGLES/DEGREES | SPEED | |
|---|---|---|---|---|---|
| LOW FLEX | 13 | 83 | HIGH FLEX | 9 | 85 |
| | 16 | 84 | | 14 | 85 |
| | 8 | 83 | | 11 | 83 |
| | 13 | 82 | | 9 | 84 |

-continued

| ANGLES/DEGREES | | SPEED | ANGLES/DEGREES | | SPEED |
|---|---|---|---|---|---|
| MID FLEX | 2 | 80 | MID/HIGH | 16 | 84 |
| | 17 | 78 | | 17 | 82 |
| | 19 | 79 | | 14 | 78 |
| | 17 | 80 | | 15 | 84 |

In the above example, the HIGH FLEX is the shaft selected for the particular stiffness being tested. In this instance the parameters fall within the 0 to 15 degrees , open or closed at impact with a plurality of swings i.e. four (4) times. The HIGH FLEX is the shaft of choice in this instance. The HIGH FLEX has the best overall ANGLE/DEGREES in relationship to zero (0) degrees at impact, open or closed 0 to 15 degrees. In this instance the flex with the highest RELIABLE speeds recorded and the ANGLE/DEGREES in relationship to zero (0) degrees open or closed at impact, is the selection to be made. Thus the selection in this flex choice is the HIGH FLEX.

If the choice falls within these parameters 0 to 15 degrees, open or closed at impact, the selection is made and then go to the print out sheet with the final instructions.

The above-referenced angle/degrees ranges of 0–8 degrees, 0–11 degrees, and 0–15 degrees are created and used in view of the various different levels of play existent in golfers today and in the past. This affords a more precise selection criteria for selecting the proper or best flex choice for the one being tested. Of course, one could only use an angle/degrees range of 0–15 degrees and select on the basis of closest to zero degree, or angle/degrees average closest to zero degrees, but such is probably not as accurate as the 0°–8°, 0°–11°, and 0°–15° selection criteria.

EXAMPLE-4th CHOICE

Greater Than 15 Degrees Swing Path, Angle/degrees, Open or Closed at Impact

| | PATH OF CLUB HEAD AT IMPACT | | | | |
|---|---|---|---|---|---|
| | INSIDE OUT | STRAIGHT | OUTSIDE IN | ANGLE/DEGREES | SPEED |
| LOW FLEX | | X | | 16 | 83 |
| | | | X | 19 | 84 |
| | | | X | 19 | 83 |
| | | X | | 15 | 82 |
| MID FLEX | X | | | 20 | 80 |
| | | | X | 13 | 78 |
| | | | X | 19 | 79 |
| | | | X | 19 | 80 |
| HIGH FLEX | | | X | 16 | 85 |
| | | X | | 13 | 85 |
| | | | X | 17 | 83 |
| | | | X | 23 | 84 |
| MID HIGH | X | | | 17 | 84 |
| | X | | | 16 | 82 |
| | | | X | 17 | 78 |
| | X | | | 16 | 84 |

With reference to the example above, a different set of parameters will be used for this selection of flex choice. The first priority is the SWING PATH (deflection) of the club head at moment of impact. The invention analyzer will choose the shaft with the best results of the four (4) flex choices in that stiffness chosen for testing. The three (3) choices as displayed by the analyzer will be selected in this order: 1 st-STRAIGHT, 2nd-INSIDE OUT, 3rd-OUTSIDE IN. Straight, in most instances, is the first swing path of choice because it will give us the most consistency or accuracy. The path/paths with the most consistency is what is preferable. Straight will give you the lowest angles/degrees at impact, either open or closed. With regard to "consistency", it has been my experience in testing at this level of play that particular characteristics of his or her swing could constitute "special needs". Accordingly in this $4^{th}$ choice, the priority of choices are: Angles/degrees is secondary to the primary consideration of swing path/paths (deflection).

Once the path/paths parameters have been determined that are acceptable, the ANGLE/DEGREES open or closed at impact selected which in the first three choices (0–8 degrees open or closed at impact, 0–11 degrees open or closed at impact, and 0–15 degrees, open or closed at impact) was the main consideration after establishing reliable speeds, become secondary to the path/paths of the club head at impact. In the $4^{th}$ choice example above there are two possibilities.

The first choice is the LOW FLEX shaft in the stiffness A (speeds between 79 and 85 mph) being tested in this example. The LOW FLEX paths shown; 2 straight and 2 outside in. The ANGLE/DEGREES and the reliable speeds are consistent also. When the direction of the paths of the clubs being tested is considered first, there is a pattern or consistency as it records in that flex overall generally or in this instance the LOW FLEX. In most instances there is one choice of shaft in a specific flex in that stiffness. There are exceptions. If the golfers skills were limited or new at this time, then a stiffer shaft could be selected by the instructor to promote greater accuracy. This however will result in a loss of distance with shafts that have existed by prior art or future art based on today's standards. When the golfers skills improve, the golfer would be retested and the proper shaft selected. The golfers' present club heads could be rebuilt to accommodate the new shafts if desired. In most instances golf club heads as they exist on the market today can be rebuilt using my inventive methods if desired. This also indicates the golfer is proceeding in the direction of ZERO degrees or square at impact, which is the eventual goal of every golfer combined with the highest attainable speeds based on the individual's abilities. Using these outlines will give the customer the most consistency based on their level of play at that time of their game development.

The second flex choice in this example would be the MID HIGH FLEX based on the stiffness selected for testing. All the parameters fall within the fourth choice so either choice would be acceptable. If the customer does not have a problem getting the golf ball airborne the MID HIGH FLEX shaft will give him or her consistent ball flight at their level of play. The operator will observe the flight of the golf ball being struck while testing in this choice and aid the golfer in the final selection based on his or her experience if there is more than one choice.

EXAMPLE: If the customer needs aid in getting the ball airborne, then the LOW FLEX would be the shaft of choice for him or her and will give one consistent ball flight also. The characteristics of the shaft from an engineering standpoint when striking a golf ball have been established by prior art. Of course, full ball flight is only observed outdoors, so an outdoor test would be necessary. If the test is conducted indoors, it may also be necessary to test outdoors for best selection of a flex choice for ball flight or trajectory. Indoor ball flight is now becoming possible through computer generated programs.

In the $4^{th}$ choice decision process STRAIGHT will be the path of first choice. The second choice is INSIDE OUT and the third is OUTSIDE IN. If there is only one choice of the four (4) flexes tested in a specific stiffness, then the question is asked, "Was there only one choice in the four (4) shafts that were being tested with those individual flexes in that specific stiffness?". If the answer is YES, then that one choice will be displayed on the screen. The documentation of finished increments and cutting instructions incorporated into the program in the flex and stiffness desired will be incorporated into the finished information sheet and this ends the process. This is depicted in FIG. 6.

With regard to the fourth choice, such is provided for a "subjective" choice/approach which allows an instructor to provide to the player the best flex choice to improve the players accuracy, consistency and overall ability for better play. Of course, the players input/desire should also be considered with the fourth choice.

The documentation contained within the finished increments for cutting instructions and shaft choice will appear on the display, and/or will be provided by printer 20 and that will be the selection. The selection process is predicated on the 1st, 2nd, 3rd or 4th choice as indicated above in that specific order.

If the answer is "NO" to the above question, another set of choices of the flexes or flex choices tested in that stiffness will occur. The display monitor will then display the choices and the choice having the most consistent ANGLE/DEGREES, open or closed at impact, will decide which flex shaft is the flex of choice in that specific stiffness. If the path and the angle/degrees are the same, then the shaft in that flex choice and stiffness would be predicated on the higher reliable speeds.

Documentation of finished increments and cutting instructions will then be processed and that is the end of the process. The information of the choice will then be incorporated into the information sheet for the customer.

Remember, in the first three selections or choices, which are 0 to 8 degrees, 0 to 11 degrees and 0 to 15 degrees, open or closed at moment of impact, the invention analyzer will choose the best flex choice in the shaft stiffness that was selected to test with. The computer program will through a series of deductions eliminate the shafts that are not acceptable within the parameters I have outlined. For my test purposes, four different flex or kick points in the desired shaft stiffness are tested. These examples of the four (4) choices above illustrate the use of my method/invention. The fourth choice through a series of deductions operates to eliminate the shafts that are not within the parameters I have outlined also. The difference being in the first three (3) choices the first priority was angle/degrees and the fourth choice the first priority was the swing path (deflection). The deductive reasoning will choose one of the four (4) choices in the specific order they are programmed to determine the shaft of choice.

The example below based on reliable speeds is a remote possibility. It validates the process of my method/inventions.

EXAMPLE

SAME RECORDED ANGLES/DEGREES, OPEN OR CLOSED AT IMPACT ($5^{th}$) With Definitions

| ANGLES/DEGREES | SPEED | | ANGLES/DEGREES | SPEED | |
|---|---|---|---|---|---|
| LOW FLEX | 2 | 80 | HIGH FLEX | 6 | 79 |
| | 6 | 85 | | 4 | 80 |
| | 6 | 85 | | 6 | 80 |
| | 4 | 81 | | 2 | 84 |

-continued

| ANGLES/DEGREES | SPEED | | ANGLES/DEGREES | SPEED | |
|---|---|---|---|---|---|
| MID FLEX | 6 | 80 | MID/HIGH | 6 | 84 |
| | 2 | 85 | | 4 | 82 |
| | 4 | 84 | | 6 | 78 |
| | 6 | 80 | | 2 | 84 |

In the above example and as shown in FIG. 5, if the ANGLE/DEGREES at impact, either open or closed on a specific stiffness being tested in the four flexes or kick points are equal, how is the choice determined? In the example above, all of the ANGLE/DEGREES fall within the ZERO to 8 degrees range and the speeds are relative in terms of overall consistency. The flex with the highest speeds would be the logical choice. The following conclusions can be drawn from the example. In most instances the choices in any given stiffness are limited to two. In this example it is four, or is it? Whenever a situation like the above could occur, it informs the operator the person being tested is a body swinger which is defined as a player that has little or no hand movement which is important for overall better play.

This will not allow the shaft in that particular stiffness to flex and the results will be practically the same. This will not, however, change the overall results and the flex choice will remain the same even after improvement through lessons or other choices. I have determined that there is really only one choice and the selection of the proper flex in a specific stiffness of the four flex choices being used for testing will now be based on the higher speeds with the lower ANGLE/DEGREES at impact either open or closed. The MID FLEX is the shaft of choice because AS THE "SPEEDS" INCREASE, THE "ANGLE/DEGREES" DECREASE. In the example of the LOW FLEX you will see that as the speeds increase the ANGLE/DEGREES or deflection INCREASE. The invention method/program will convert any and all variations to accommodate this problem as presented in the preceding example.

In all of the selection/decision making methods, it is vital that the selection is based upon the angles/degrees being as close to zero degrees as possible, with the club head open or closed at impact. The fourth choice is the only instance where the swing path is the most critical choice, and the angles/degrees become the second choice. The ability to control the shot making decision process will enable the player to progress at a faster learning rate and enable the scores to come down. Unless there are dramatic changes in the swing, the golfer will continue to use the same stiffness and flex choice in the shaft selection process described herein above.

The monitor 18 will display the shaft choice on the screen and the documentation contained within that screen will be incorporated into the finished information sheet and the process will end.

It is well within one of ordinary skill in the art to provide a printer 20 for printed results.

This will end the invention process and the selection will appear on the final print out sheet. The final print out sheet will also have information that can only be obtained through physical measurements of the person taking the test. The additional measurements consists of final grip size in terms of diameter, proper lie and finished length. A final print out sheet containing the information needed is then printed in order to build the proper golf equipment.

It is also well within one of ordinary skill in the art to provide a system wherein the recorded swing information is obtained at a remote site and then transmitted by facsimile or otherwise to a central station which could be located at a manufacturing location and the data could be processed in accordance with my invention, clubs built and shipped.

In order to implement my inventive methods/processes set forth above, there is shown in FIG. 9 a schematic block diagram of the system invention which comprises: a software or program controlled processor means 14 connected via appropriate interface means 12 with a golf swing analyzer means 10. The depicted system includes stored data means 16, a monitor/display means 18, and printer means 20. As set forth herein before, the system invention may be implemented into a fully automated software controlled system, as shown in FIG. 9, and operator intervention may also be utilized. Furthermore, this is applicable to the determination of unreliable or reliable swing speeds. It should be within the skill of one ordinary skilled in the art to devise software for determining a reliable swing speed or unreliable swing speed, by and within the invention teachings provided herein. With respect with the utilization of operator intervention, a semi-automated system which allows for operator intervention, in accordance with the present disclosure and the flow charts provided herein, may be provided.

Thus, it is apparent that there has been provided, in accordance with the disclosed invention that fully satisfies the objectives, aims at advantages set forth above: While the inventions methods and system have been described in conjunction with specific embodiments thereof, it is evident that many alternatives, modifications and variations will be apparent to those skilled in the art in light of the foregoing description. Accordingly, it is intended to embrace all such alternatives, modifications and variations which fall within the spirit and scope of the appended system claims.

We provide herein below examples of the FM Precision Shafts as established by prior art, which I have tested and used in my invention/analysis methods and system:

1) Microtaper-low flex combination A/L stainless steel, parallel tip;
2) Microtaper-low flex combination R/S stainless steel, parallel tip;
3) Phoenix mid flex combination A/L stainless steel, parallel tip;
4) Phoenix mid flex combination R/S stainless steel, parallel tip;
5) Standard mid high flex L stainless steel, parallel tip;
6) Standard mid high flex R stainless steel, parallel tip;
7) Standard mid high flex S stainless steel, parallel tip;
8) Propel II high flex combination R/S stainless steel, parallel tip; and
9) Propel II high flex combination A/L stainless steel, parallel tip.

I claim:

1. A method of precisely fitting a golfer to a selected stiffness of a golf shaft and to a selected flex choice of a golf shaft comprising the steps of:

a) electronically testing and recording a golfers club head swing speeds a plurality of times;
b) electronically determining, recording and storing for analysis a predetermined plurality of reliable club head swing speeds;
c) electronically providing a plurality of predetermined club head swing speeds ranges, one for each shaft stiffness value;
d) electronically selecting said stiffness of a golf shaft to fit said golfer by comparing said tested and recorded plurality of reliable swing speeds to said plurality of predetermined club head swing speeds ranges, and making the electronic selection based upon a comparative speed range for said shaft stiffness value; and further including the steps of electronically selecting a preferred flex choice for said selected shaft stiffened by:
e) electronically testing a plurality of golf shafts of the same selected stiffness value and having different flex choices;
f) electronically recording and storing a plurality of angle/degrees values and respective club head swing speeds for each of said plurality of golf shafts as they are tested;
g) electronically determining by predetermined analysis which set of recorded angle/degrees values for each shaft tested is closest to zero degrees; and
h) electronically selecting the golf shaft flex choice for said golfer based upon the flex of the set for which the recorded angle/degrees values is closer to zero.

2. A method as defined in claim 1 further including the step of electronically selecting the golf shaft flex choice based upon the set of said angle/degrees values wherein the average value is closest to zero degrees.

3. The method as defined in claim 2 wherein said step of electronically selecting the golf shaft flex choice based upon the set for which the said recorded angle/degrees values is closest to zero for a selected and tested shaft stiffness value, is made within an angle/degrees range of 0 to 15 degrees.

4. A method as defined in claims 1 or 2, including:

a) electronically providing a specific plurality of angle/degrees ranges of: 0 to 8 degrees, 0 to 11 degrees, 0 to 15 degrees and greater than 15 degrees, each open or closed at impact; and utilizing these said ranges for the electronic programmed selection of a proper flex choice for the golfer being tested.

5. The method as defined in claim 4 wherein for said angle/degrees ranges of 0 to 8 degrees, 0 to 11 degrees, and 0 to 15 degrees, the priority electronic selection is based on angle/degrees values closest to zero degrees, higher reliable club head swings speeds being secondary to this said priority.

6. The method as defined in claim 4, wherein for the angle/degrees range of greater than 15 degrees, the priority electronic selection is based on swing path, with a first choice of "straight", a second choice of "inside-out", and a third choice of "outside-in", the recorded angle/degrees values and club head swing speeds being secondary to said choices.

7. The method as defined in claim 1 further including the step of testing shaft flex choices of low, mid, mid-high, and high.

8. A computer software controlled system for precisely fitting a golfer to a selected stiffness of a golf shaft and to a selected flex choice of a golf shaft comprising:

a) first electronic means for testing, recording and storing a golfer's club head swing speeds a plurality of times;
b) second electronic means for determining, recording and storing for analysis a predetermined plurality of reliable club head swing speeds;
c) third electronic means for providing a plurality of predetermined club head swing speeds ranges, one for each shaft stiffness value;
d) fourth electronic means for selecting said stiffness of a golf shaft to fit said golfer by comparing the tested and recorded plurality of reliable swing speeds to said plurality of predetermined club head swing speeds ranges and selecting a shaft stiffness based upon a comparative speed range for said shaft stiffness value;

e) fifth electronic means for selecting a preferred flex choice for said selected shaft stiffness by providing means for testing a plurality of golf shafts of the same selected stiffness value and having different flex choices, and by providing means for recording and storing a plurality of open or closed at impact angle/degrees values for each of said plurality of golf shafts as they are tested;

f) sixth electronic means for determining by predetermined analysis which set of said recorded angle/degrees values for each shaft tested is closest to zero degrees, and for determining which set of said values wherein the average value is closest to zero degrees; and g) seventh electronic means for selecting the golf shaft flex choice for said golfer based upon that set forth in step f) above.

9. The system as defined in claim 8 further including display means for visually displaying said system operations controlled by software and for displaying to the tested golfer or a system operator data identifying the golf shaft stiffness and flex choice selection made by the said system.

10. The system as defined in claim 8 further including printer means for printing documentation of a golfer's physical measurements and special needs, grip size diameter, proper lie, shaft length, and shaft cutting instructions, for building the golf equipment for the tested golfer.

11. The system as defined in claim 8, wherein said system is operational on a fully-automated basis and also on a semi-automated basis which includes operator intervention and system control.

12. The system as defined in claim 8 including means for transmitting from one site location, said electronically recorded and stored data of reliable club head swings speeds values and respective angle/degrees values, to receiving means located at another site location at or near a manufacturing site so that the data can be analyzed and processed and golf clubs built in accordance with the electronic selections made, and shipped to the golfer/player customer and the like.

* * * * *